US005799799A

United States Patent [19]

Alamzad et al.

[11] Patent Number: 5,799,799

[45] Date of Patent: Sep. 1, 1998

[54] ULTRASONIC SCREENING SYSTEM

[75] Inventors: Hossein Alamzad, Weehawken; William Zhao, Livingston; Alfred Heidinger, Chester, all of N.J.

[73] Assignee: Kason Corporation, Milburn, N.J.

[21] Appl. No.: 642,877

[22] Filed: May 6, 1996

[51] Int. Cl.[6] ..... B07B 1/42; B07B 1/50

[52] U.S. Cl. ..... 209/365.1; 209/379; 209/381

[58] Field of Search ..... 209/323, 364, 209/365.1, 365.2, 366, 366.5, 367, 379, 381

[56] References Cited

U.S. PATENT DOCUMENTS

| | | | |
|---|---|---|---|
| 3,490,584 | 1/1970 | Balamuth . | |
| 4,693,879 | 9/1987 | Yoshimura et al. | 209/379 X |
| 5,143,222 | 9/1992 | Monteith | 209/365.1 X |
| 5,386,169 | 1/1995 | Dubruque | 209/365.1 X |
| 5,398,816 | 3/1995 | Senapati | 209/364 |

FOREIGN PATENT DOCUMENTS

| | | | |
|---|---|---|---|
| 5068945 | 3/1993 | Japan | 209/379 |
| 2187531 | 9/1987 | United Kingdom | 209/364 |

*Primary Examiner*—William E. Terrell
*Assistant Examiner*—Tuan N. Nguyen
*Attorney, Agent, or Firm*—Stanley J. Yavner

[57] ABSTRACT

A device for screening cohesive material, and for eliminating screen blinding, is disclosed. The device includes a transducer for transmitting ultrasonic frequency throughout the screen surface, with the transducer supported independently of the screen in order to prolong screen life and to lower screen replacement costs. The transducers are provided with adjustable mounting means in order to adjust the transducer position with respect to the screen.

6 Claims, 3 Drawing Sheets

ULTRASONIC SCREENING SYSTEM

FIELD OF THE INVENTION

This invention relates primarily to screening devices, and re particularly to screening devices wherein an ultrasonic source impacts the screen surface for enabling the screening of cohesive material.

BACKGROUND OF THE INVENTION

A constant problem in standard vibratory screens used for fine materials, powders and other materials is the clogging or sluggish transmission of the materials through the screen at various points throughout the screen.

Different solutions have been suggested, such as by the use of ultrasonic or mechanical systems to perform anti-blinding functions with respect to the screening process. Sweco, Incorporated of Florence, Kentucky has suggested two ultrasonic systems, the first embodied in their product now being sold, which suggests the attachment of an ultrasonic transducer, by being affixed onto a chord, which, in turn, is secured to the screen mesh (the chord being a chord of the circular shape of the screen). A modification of the same company is embodied in U.S. Pat. No. 5,398,816 issued Mar. 21, 1995. The patented item attaches a transducer to the vibratory screen frame, which is placed at the periphery of the screen structure for supporting the mounting and screen tension.

In the first of the Sweco devices described above, there is the drawback of a requirement for screen replacement or repair also requiring replacement of at least the transducer mounting, if not the transducer itself. Also both Sweco devices suffer from the advantage that the position of the transducer and its application of ultrasonic vibration to the screen is fixed, rather than adjustable. Also, particularly with respect to the Sweco product (as distinguished from the patented device), the device parameters as suggested are limited to their application for circular screens.

In terms of other attempts at ultrasonic anti-blinding systems or anti-clogging systems, Russell Finex Ltd. owns U.S. Pat. No. 5,143,222, issued Sep. 1, 1992, wherein the capability is set forth for using single or multiple transducers, but again, as with the Sweco devices, the Russell Finex patented devices bond a disk to the screen and bolt the transducer to the disk, thus likewise suffering from the drawback that the position of the transducer is not adjustable.

Still further, U.S. Pat. No. 3,490,584, issued Jan. 20, 1970 to Balamuth, and assigned to Cavitron Corporation, attempts to solve the problems addressed herein by using a transducer for application to the material being screened. In other words, Balamuth places his trans-ducer above the screen without touching it, and slightly immersed into the material being screened. Of course, the adjustability feature, in terms of location, discussed in the foregoing, is also missing in the Balamuth device. Also, the application of the transducer output is on the material being screened, rather than on the screen itself, which is of less effect in terms of removing clogs or the like.

OBJECTS AND SUMMARY OF THE INVENTION

Accordingly, a primary object of the present invention is to provide a screening assembly, wherein a transducer, supported independently of the screen mesh of the screening assembly, applies a vibration to the screen in order to prevent clogging of the screen.

A more particular object of the present invention is to provide a screening assembly, with a transducer, supported independently of the screen mesh, and held in place by straight or circular mounting or support rods, wherein the position of the transducer, relative to the screen mesh, is adjustable, and with the transducer placed above or below the screen.

A still further object of the present invention is to provide a separator or sifting assembly in a structure, which includes a screen, and one or more transducers, wherein a repair or replacement of the screen does not require removal of the transducer.

Additionally, a transducer device is provided, with its object being to prevent clogging in a screen.

These and other objects of the present invention are provided in a separator system, featuring one or more transducers and a circular or other shape screen mesh. The transducers are supported independently of the screen mesh, thereby providing enhanced screen performance and lower screen replacement costs. The mounting of the transducer or transducers is structured such that the position with respect to the screen mesh is adjustable. The screen mesh may be with or without center tensioning and the transducers emit ultrasonic energy for application to the screen, with variable amplitude.

A circular or straight mounting rod is used for supporting the transducer or transducers in varying positions with respect to the screen mesh.

BRIEF DESCRIPTION OF THE DRAWINGS

Other objects, features and advantages of the present invention will become apparent from the following more detailed description of a preferred, but nevertheless illustrative, embodiment, with reference to the accompanying drawings, wherein.

DETAILED DESCRIPTION OF THE PREFERRED EMBODIMENT

Figure 1:
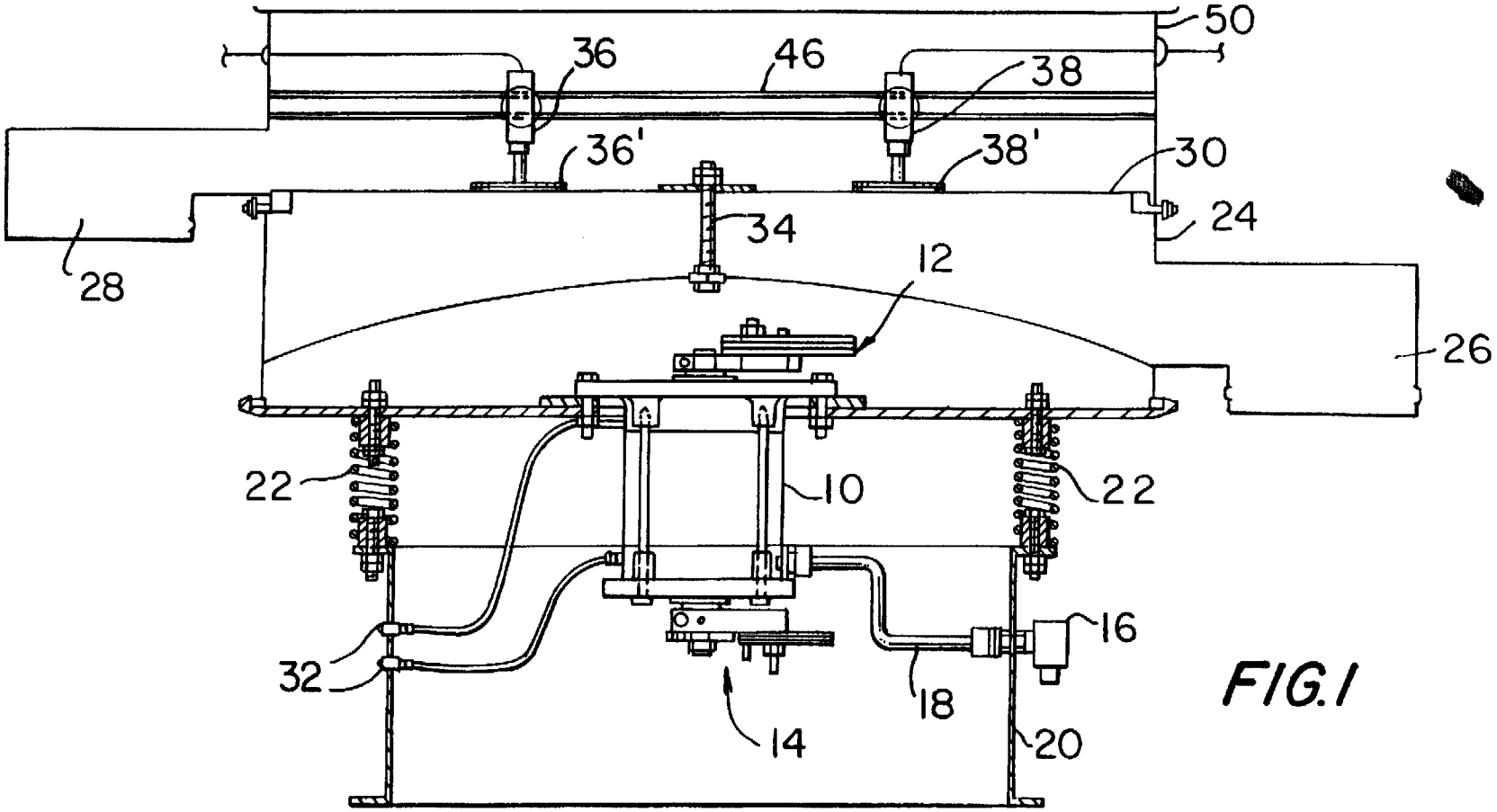
FIG. 1 is a front and partial schematic and sectional view of a substantial portion of a vibratory separator or sifting assembly structure, showing particularly the mounting above the screen mesh thereof of a pair of transducers for transmitting ultrasonic vibrations to the screen mesh thereof.
Figure 2:
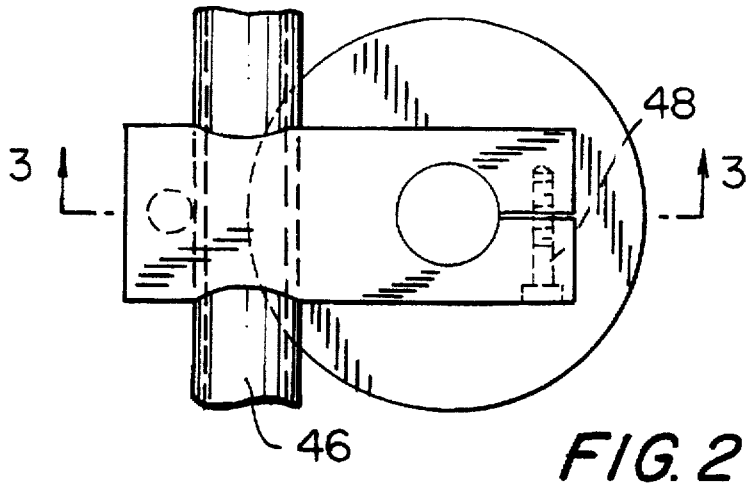
FIG. 2 is a partial top view of the assembly of FIG. 1, showing particularly the transducer and the mounting thereof on a support rod.
Figure 3:
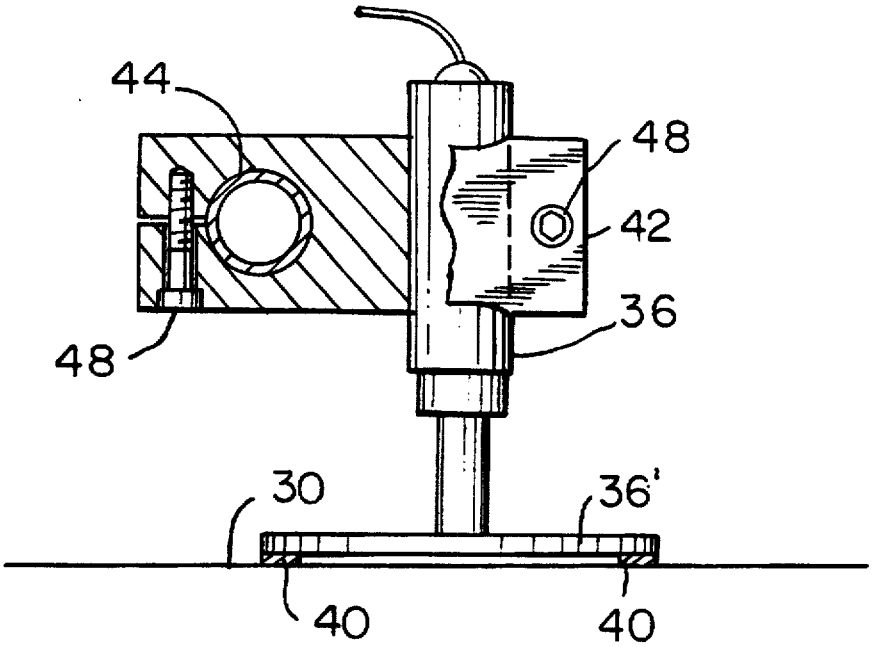
FIG. 3 is a front view, partially in section, taken along the line 3—3 of FIG. 2, and showing particularly the various parts of the transducer structure, and its relationship with the screen mesh and the separator assembly.
Figure 4:
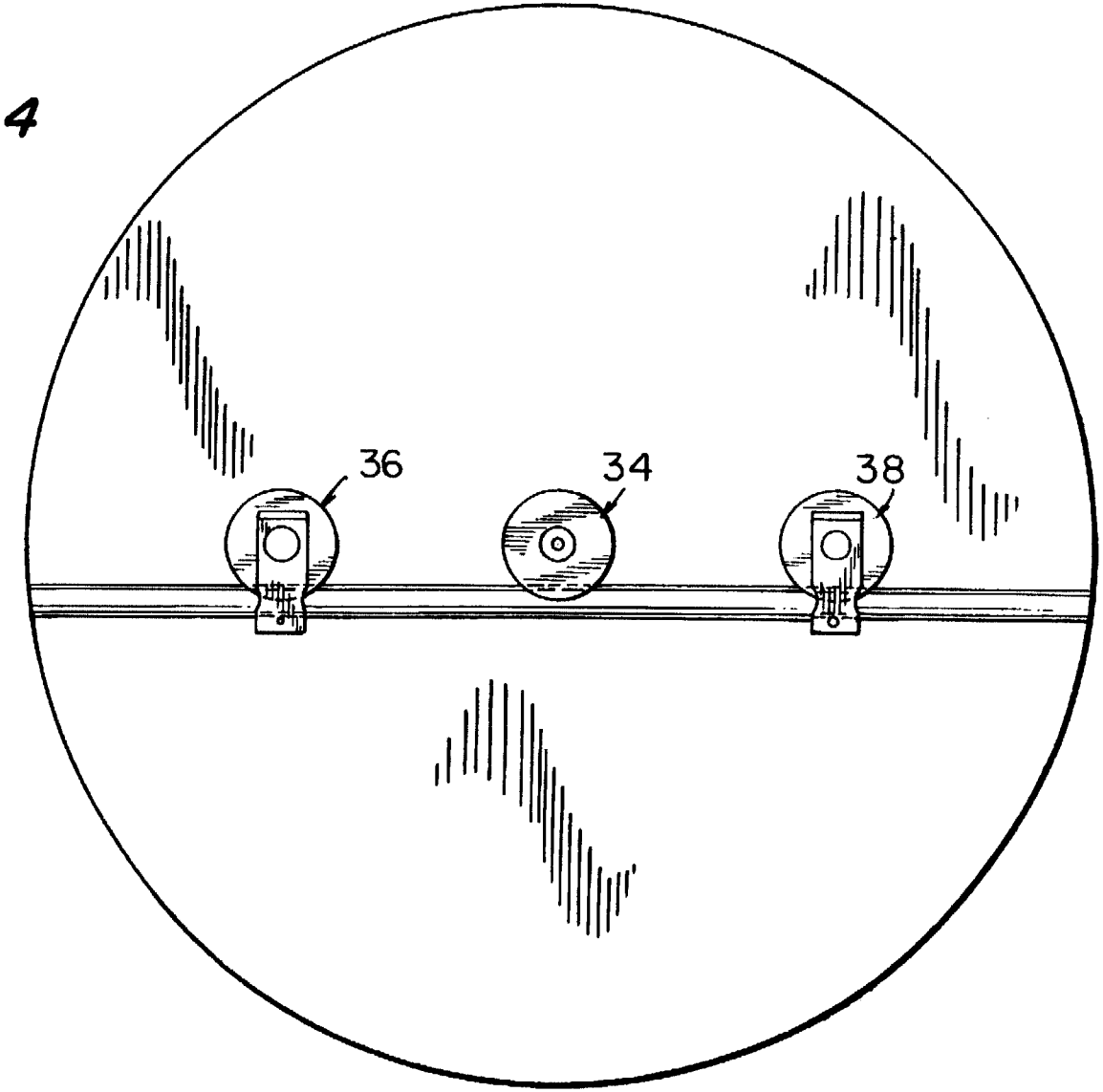
FIG. 4 is an expanded top view, similar to that shown in FIG. 2, with a pair of transducers being shown in relation to a circular screen mesh, the center of which is tied down to provide center tensioning of the screen mesh.

Referring to the drawings and particularly FIG. 1 thereof, a separator system apparatus, for use with a transducer structure according to the present invention is shown in its typical form as including a gyrator 10 having upper and lower eccentric weights generally designated 12 and 14, an electric junction box 16 for providing power through motor cord 18 to gryrator 10. All of these elements are arranged in a base 20 for mounting, by means of springs 22, a separator frame 24, which defines and provides a discharge outlet 26 and a spacing frame 50 with an oversized particle discharge 28.

A mesh screen 30 is shown on the upper part of frame 24. Of course, the other details of the usual vibrating separator assembly structure, such as grease fittings 32 are as usually found in this type of apparatus; but the upper or transducer portion shown in FIG. 1 provides a combination with the separator apparatus, and is in and of itself, the novelty of this invention.

As is present in many of the prior art designs there is a center tie-down device 34, shown in FIG. 1, but in this assembly it is optional, and not required for the present invention. In more detail, however, in terms of the transducer portion of the present invention, FIG. 1, 2, 3 and 4 show the details, whereby transducers 36, 38 constitute an important portion thereof. Transducer 36 is mounted on ultrasonic transmission disk 36' and transducer 38 is mounted on ultrasonic transmission disc 38'. In turn, ultrasonic transmission disc 36' (as with ultrasonic transmission disc 38' if multiple transducers are used) is mounted on elastic pads 40. Holder 42 for transducer 36 is in order to hold the transducer on the screen in order to adjust the tension against the screen 30. Holder support 44, on the other hand is to vary the location of the transducer 36 with respect to screen 30, as is shown most clearly in FIG. 2, which shows the transducer mounted on, and movable with respect to, a support rod 46 of suitable shape (in this case circular, but it may be square). Of course, suitable holder clamp bolts 48 are provided in order to properly hold the transducer assembly, as shown, together.

As to the transducer 36 itself, a suitable such device is available, for instance, from Sonics and Materials, Inc. of Danbury, Conn., wherein many of the transducers rate between 20 and 50 kHz, and generators up to 200 watts are usable in the present invention for generating ultrasonic energy. Of course, transducers with ranges exceeding those limits and designated wattage, and below such limits and wattage, are also suitable.

Likewise, other aspects of this invention are limited only by the scope of the following claims:

What is claimed is:

1. A transducer structure for use with a separator system having a screen mesh for separating materials fed therethrough, the transducer structure emitting ultrasonic energy for removing clogs of said materials on said screen mesh and comprising a transducer supported proximate said screen mesh, but independently thereof, said transducer, in turn, comprising means for emitting ultrasonic energy onto said screen mesh, a support rod for mounting said transducer in order to provide said transducer proximate said screen mesh, but independently thereof, said transducer defining an opening for insertion of said support rod.

2. The invention according to claim 1 wherein an elastic pad is provided, and an ultrasonic transmission disc is provided to contact said screen mesh through said elastic pad in order to adjust the tension against the screen mesh.

3. The invention according to claim 1 wherein means are provided in said transducer for emitting ultrasonic energy of variable amplitude.

4. The invention according to claim 1 wherein a pair of transducers are provided on said support rod.

5. The invention according to claim 4 wherein said transducer further includes means for varying the amplitude thereof.

6. The combination of a transducer structure including a support rod and a separator system having a screen mesh for separating materials fed therethrough, comprising a transducer supported proximate said screen mesh, but independently thereof, and said transducer including means for emitting ultransonic energy onto said screen mesh and defining an opening for insertion of said support rod to support said transducer at a plurality of positions along said rod.

* * * * *